US010133230B2

(12) United States Patent
Tsuda

(10) Patent No.: US 10,133,230 B2
(45) Date of Patent: Nov. 20, 2018

(54) DOOR FOR AN IMAGE FORMING APPARATUS

(71) Applicant: CANON KABUSHIKI KAISHA, Tokyo (JP)

(72) Inventor: Satoshi Tsuda, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/635,747

(22) Filed: Jun. 28, 2017

(65) Prior Publication Data

US 2018/0004151 A1 Jan. 4, 2018

(30) Foreign Application Priority Data

Jun. 29, 2016 (JP) ..... 2016-128608

(51) Int. Cl.
*G03G 21/16* (2006.01)

(52) U.S. Cl.
CPC ... *G03G 21/1633* (2013.01); *G03G 2221/169* (2013.01)

(58) Field of Classification Search
CPC ..... G03G 21/1633; G03G 2221/1684; G03G 2221/169
See application file for complete search history.

(56) References Cited

U.S. PATENT DOCUMENTS

| | | | | |
|---|---|---|---|---|
| 8,303,057 | B2 | 11/2012 | Kuramata et al. | |
| 2008/0232847 | A1* | 9/2008 | Kusukawa | G03G 21/1633 399/114 |
| 2017/0293253 | A1* | 10/2017 | Iwase | G03G 21/1633 |

FOREIGN PATENT DOCUMENTS

| | | | |
|---|---|---|---|
| JP | 2009-115948 | A | 5/2009 |
| JP | 2010-085432 | A | 4/2010 |
| JP | 2012-078419 | A | 4/2012 |
| JP | 2014-202991 | A | 10/2014 |
| JP | 2016-033316 | A | 3/2016 |

* cited by examiner

*Primary Examiner* — Sophia S Chen
(74) *Attorney, Agent, or Firm* — Fitzpatrick, Cella, Harper & Scinto

(57) ABSTRACT

An image forming apparatus includes a main assembly; an door openable and closable relative to the main assembly; a flexible connecting member connecting the door with the main assembly, the connecting member being slidable at least relative to one of the main assembly and the door, wherein the connecting member slides with opening of the door relative to the main assembly; a sliding member swingably supported by the main assembly or the door and slidable relative to the connecting member which slides. When the door is opened, the connecting member contacts, while sliding, a part of the sliding member on one side with respect to a center of swing to press the sliding member, so that the other side with respect to the center of swing of the sliding member urges the connecting member to an urged portion to retard the sliding movement of the connecting member.

20 Claims, 9 Drawing Sheets

(a)

(b)

(a)

(b)

(a)

(b)

DOOR FOR AN IMAGE FORMING APPARATUS

FIELD OF THE INVENTION AND RELATED ART

The present invention relates to an image forming apparatus such as an electrophotographic copying machine, an electrophotographic printing machine (laser beam printer and LED printer, for example).

An image forming apparatus is provided with a door which is to be opened when a jammed sheet of recording medium or the like has to be removed. An image forming apparatus provided with such a door is desired to be structured so that the entirety of its recording medium conveyance passage can be exposed by the opening of a single door.

However, if an electrophotographic image forming apparatus is structured so that the entirety of the recording medium conveyance passage which extends from its sheet feeding-conveying portion, to its fixing portion, through its transferring portion, can be exposed by the opening of only one of the doors, this door is likely to be large and heavy. If this door is heavy, the door and the main assembly of the apparatus are likely to be subjected to a large amount of shock, as the door is allowed to be opened by its own weight (allowed to free-fall). Thus, it is possible for the rod or belt by which the door is hung from the main assembly of the apparatus to be damaged.

Thus, there have been proposed structural arrangements for an electrophotographic image forming apparatus that reduce the speed with which the above-described door opens. In the case of the electrophotographic image forming apparatus disclosed in Japanese Laid-open Patent Application No. 2012-78419, its door is provided with a two-piece arm for regulating the opening angle of the door relative to the main assembly. The two sections of the arm are foldable relative to each other at a joint with which they are connected to each other. Further, the joint is fitted with a torsional coil spring so that, toward the end of the opening of the door, the door is decelerated by the resiliency of the coil spring.

In the case of the electrophotographic image forming apparatus disclosed in Japanese Laid-open Patent Application No. 2014-202991, its door and main assembly are connected by a piece of wire which is provided with a protrusive portion. It is structured so that, as the door is opened, the protrusive portion with which the wire is provided comes into contact with the protrusive portion with which a guiding member for guiding the wire is provided. Consequently, the wire is reduced in its moving speed, and therefore, the door is reduced in the speed with which it opens.

In the case of the structural arrangement disclosed in Japanese Laid-open Patent Application No. 2012-78419, the larger the door, the greater does the spring has to be in resiliency. That is, employment of this structural arrangement leads to the increase in the apparatus size and cost.

In the case of the structural arrangement disclosed in Japanese Laid-open Patent Application No. 2014-202991, not only is the wire subjected to the resistance generated by the spring when the door is opened, but also, when the door is closed. That is, the greater the door in weight, the greater the resistance necessary to reduce the door in opening speed. Thus, the mechanism for winding up the wire to close the door has to be substantial in strength, which in turn leads to the increase in the apparatus size and cost.

SUMMARY OF THE INVENTION

The present invention was made in consideration of the above-described issues. Thus, the primary object of the present invention is to provided an image forming apparatus which can more effectively decelerate its member (door), which can be opened or closed, toward the ending of the opening of the member, and yet is significantly smaller in size and cost than any conventional image forming apparatus.

According to an aspect of the present invention, there is provided an image forming apparatus for forming an image on a recording material, said apparatus comprising: a main assembly; an openable member openable and closable relative to said main assembly; a flexible connecting member connecting said openable member with said main assembly, said connecting member being slidable at least relative to one of said main assembly and said openable member, wherein said connecting member slides with opening of said openable member relative to said main assembly; and a sliding member swingably supported by said main assembly or said openable member and slidable relative to said connecting member which slides, wherein when said openable member is opened, said connecting member contacts, while sliding, a part of said sliding member on one side with respect to a center of swing to press said sliding member, so that the other side with respect to the center of swing of said sliding member urges said connecting member to an urged portion to retard the sliding movement of said connecting member.

Further features of the present invention will become apparent from the following description of exemplary embodiments with reference to the attached drawings.

BRIEF DESCRIPTION OF THE DRAWINGS

Parts (a) and (b) of FIG. 1 are schematic sectional views of the image forming apparatus in the first embodiment of the present invention.

Figure 3:
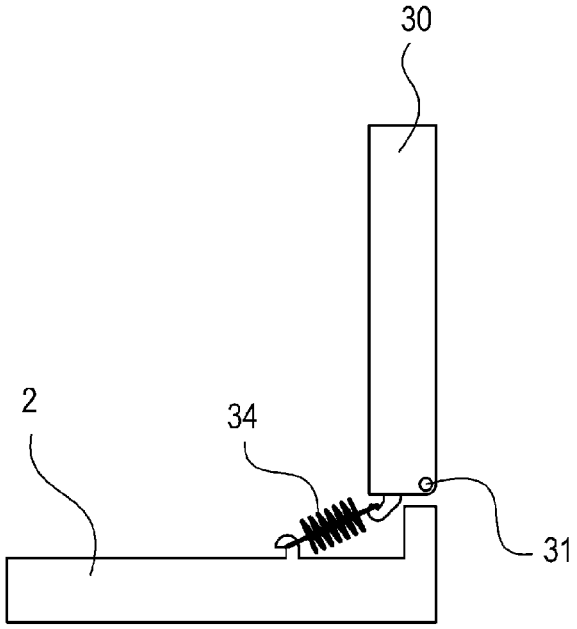
Figure 3:
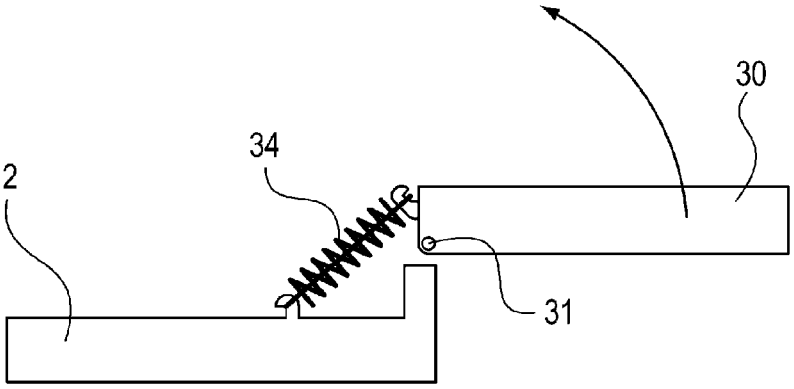

Parts (a) and (b) of FIG. 3 are schematic sectional views of a combination of the door of the image forming apparatus, and the portion of the apparatus, to which the door is attached. It is for illustrating the function of the damping spring.

Figure 4:
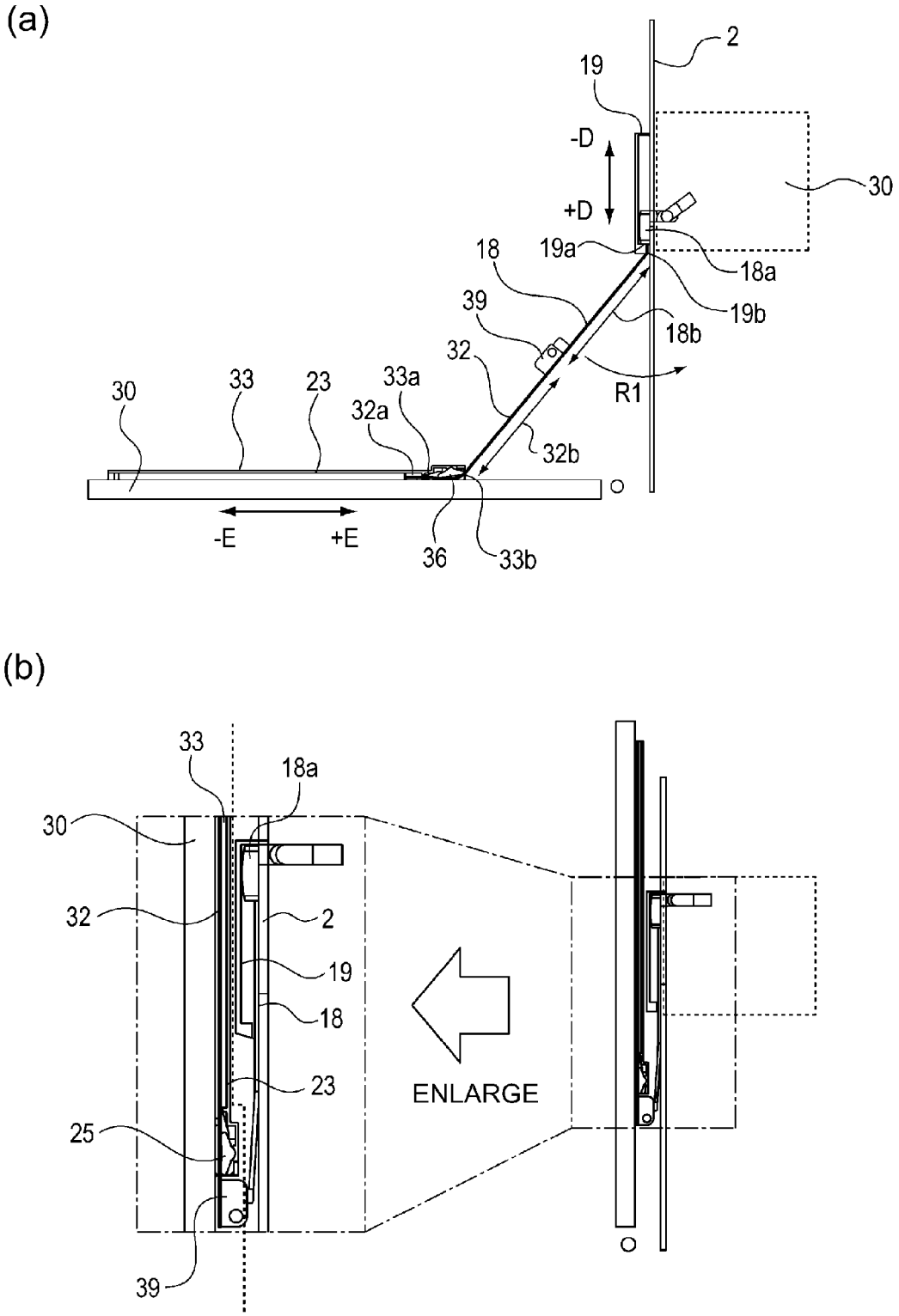

Parts (a) and (b) of FIG. 4 are combination of schematic vertical and horizontal sectional views of the door, and its adjacencies, of the image forming apparatus. It is for describing the structure of the combination.

Figure 5:
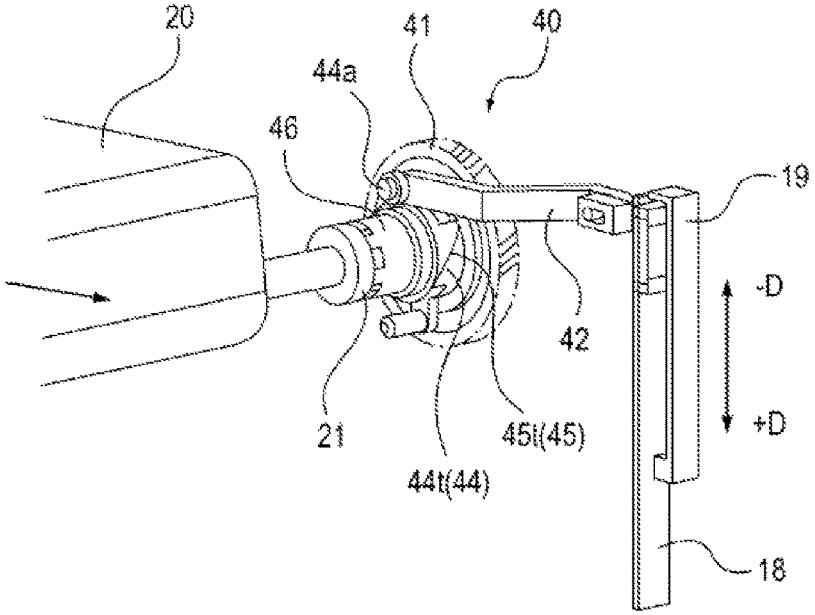
Figure 5:
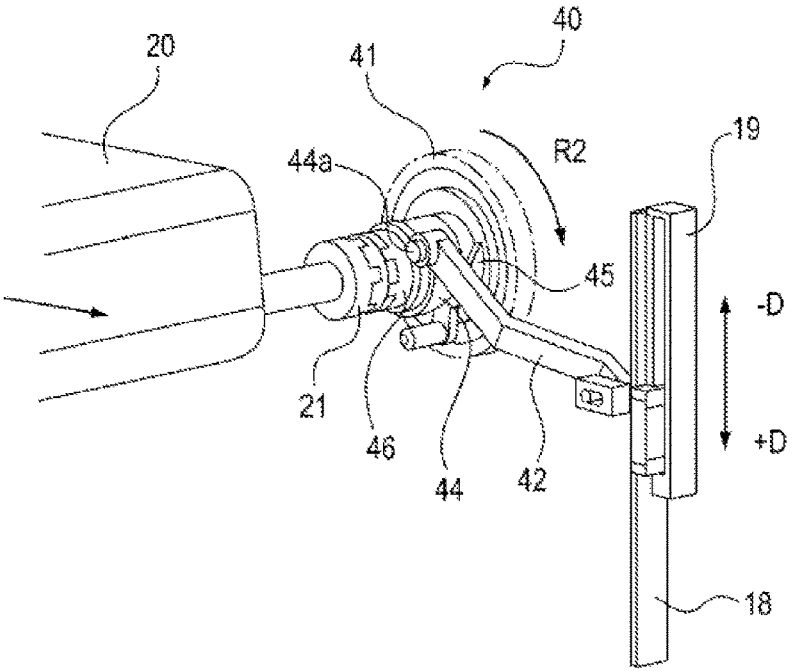

Parts (a) and (b) of FIG. 5 are schematic sectional views of the mechanism for engaging the intermediary transfer unit with the counterpart of the main assembly of the image forming apparatus to transmit driving force to the intermediary transfer unit, or disengaging the intermediary transfer unit 20 from the main assembly, or disengaging the intermediary transfer unit.

Figure 6:
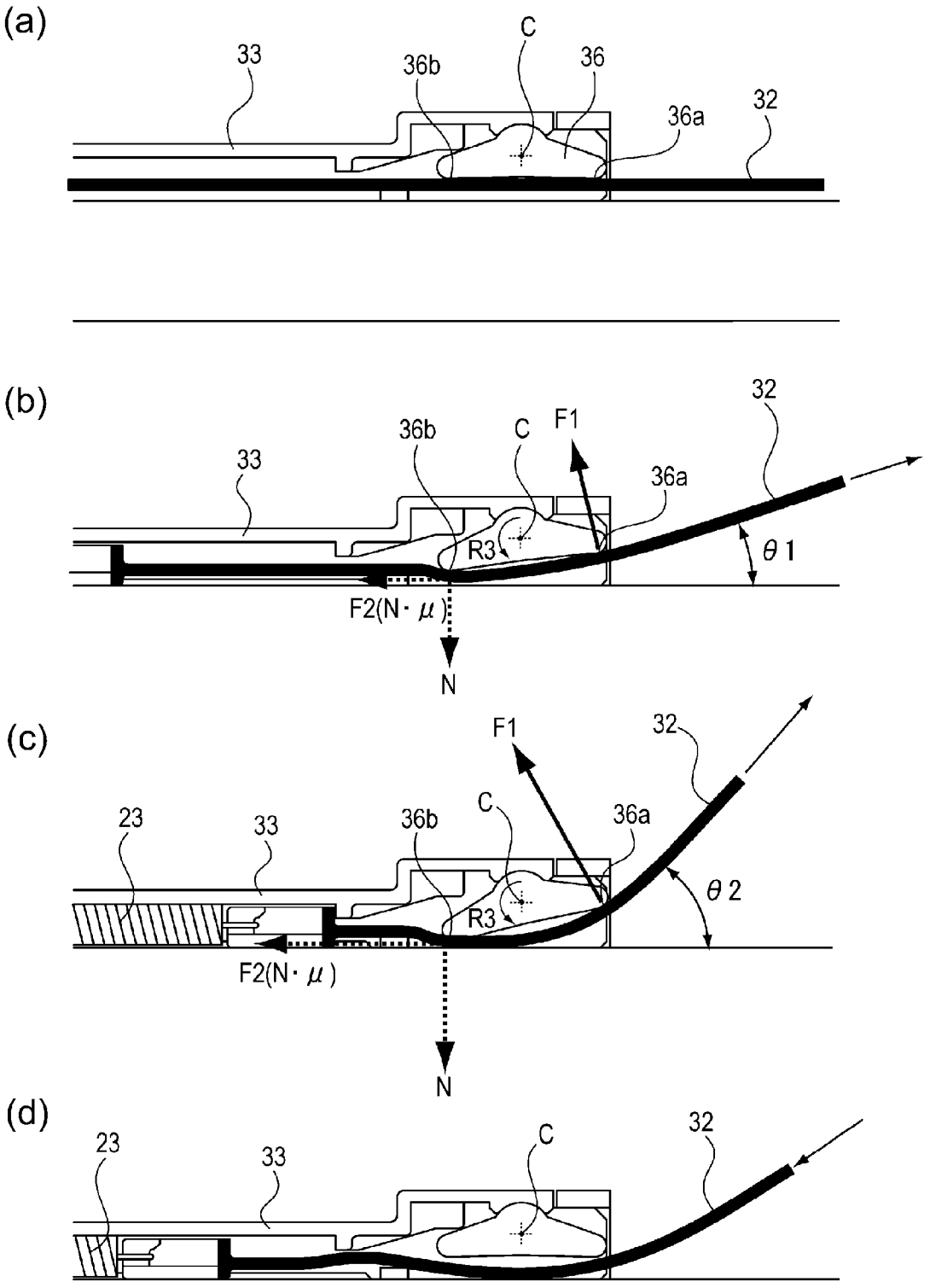

Parts (a), (b), (c) and (d) of FIG. 6 are schematic sectional views of the holder of the door. It is for describing the function of the braking cam.

Figure 7:
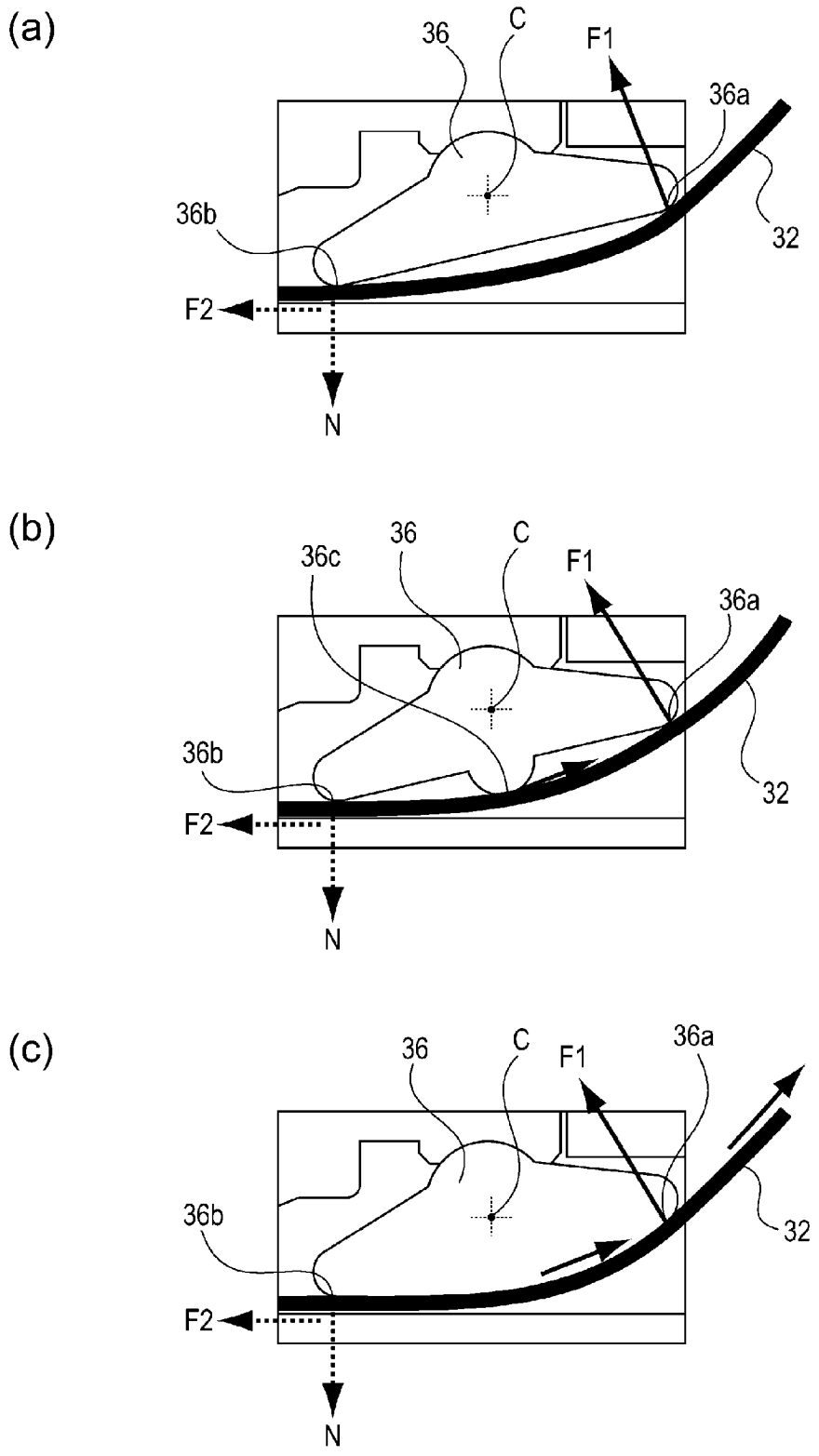

Parts (a), (b) and (c) of FIG. 7 are drawings for showing the braking cams which are different in shape.

Figure 8:
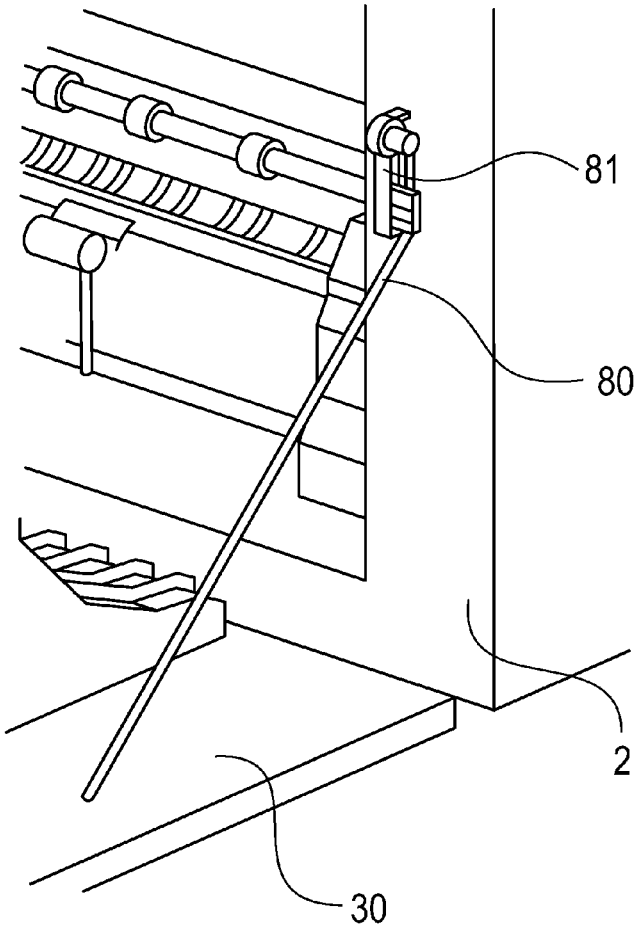

FIG. 8 is a schematic perspective view of a combination of a part of the door, a part of the door holding wire, and the part of the main assembly, to which the wire holder is attached, when the door is open.

Figure 9:
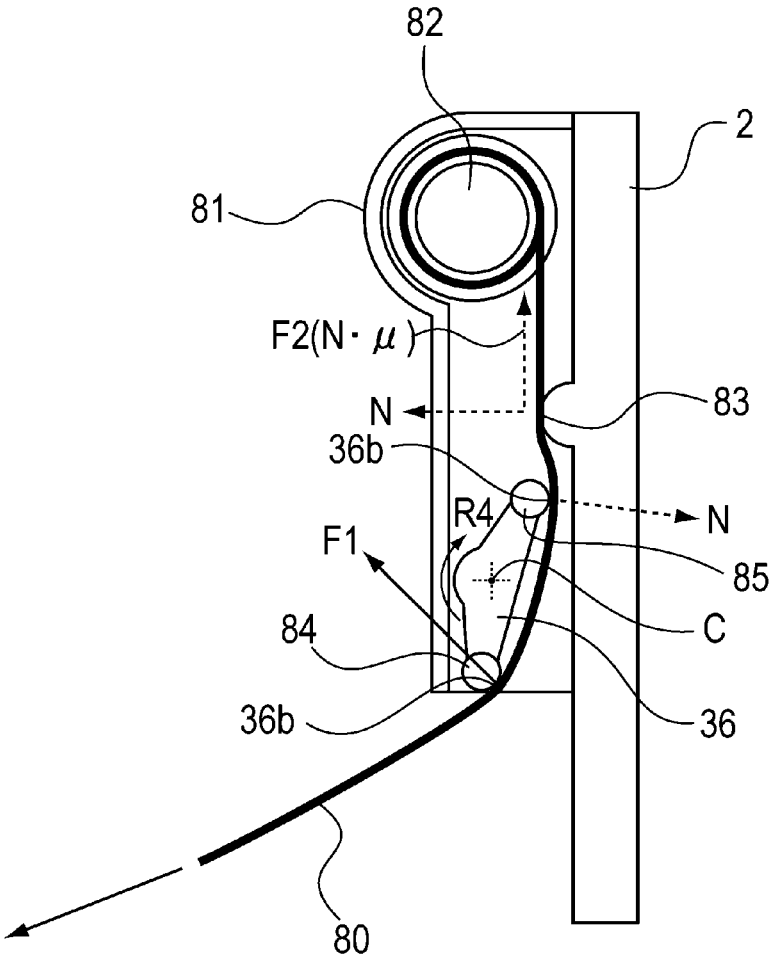

FIG. 9 is a schematic sectional view of the wire holder in the second embodiment of the present invention. It is for describing the function of the braking cam.

DESCRIPTION OF THE EMBODIMENTS

Embodiment 1

<Image Forming Apparatus>

Hereinafter, first, the image forming apparatus A in the first embodiment of the present invention is described about its overall structure along with its image forming operation, with reference to appended drawings. By the way, the measurements, materials, and shapes of the structural components of the image forming apparatus A, and the positional relationship among the components, are not intended to limit the present invention in scope, unless specifically noted.

Figure 1:
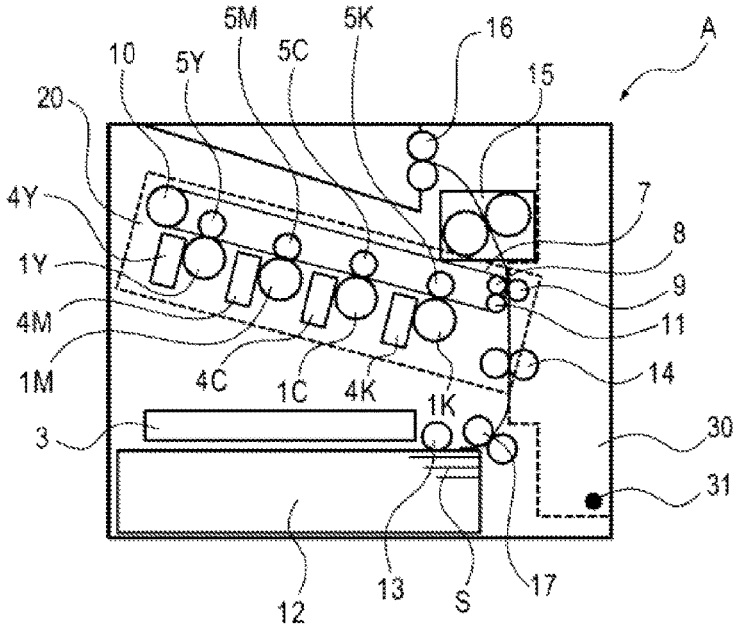
Figure 1:
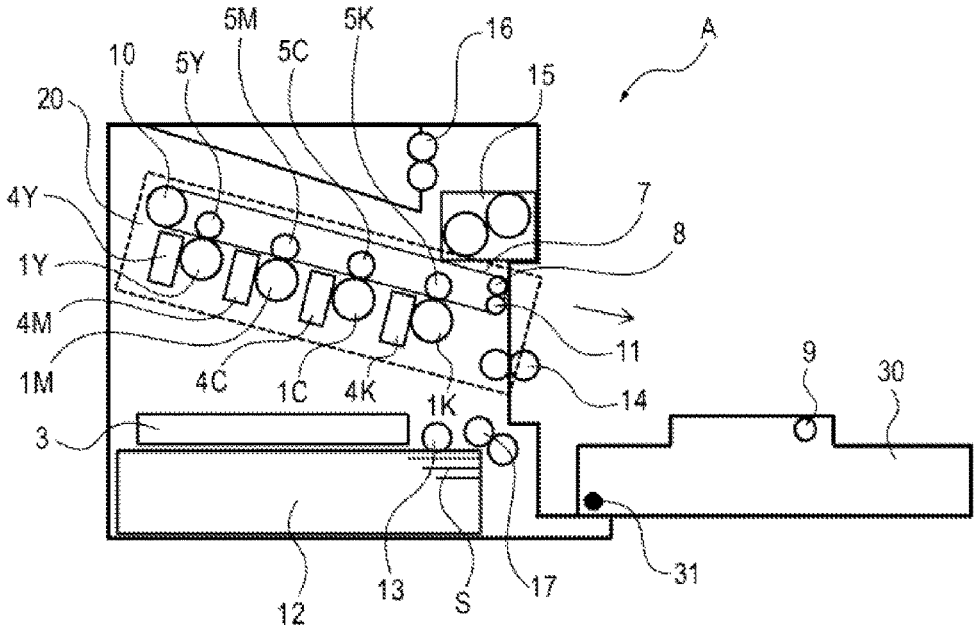

The image forming apparatus A in this embodiment is an electrophotographic color laser printer, which forms an image on a sheet of recording medium with the use of four toners, which are different in color, more specifically, yellow Y, magenta M, cyan C, and black K toners. Referring to FIG. 1, the image forming apparatus A has: an image forming portion which forms toner images and transfers the toner images onto a sheet of recording medium; a sheet feeding-conveying portion which supplies the image forming portion with the sheet of recording medium; and a fixing portion which fixes the toner images to the sheet of recording medium.

The image forming portion has: photosensitive drums 1 (1Y, 1M, 1C and 1K) as image bearing members; a laser scanner unit 3; a developing apparatuses 4 (4Y, 4M, 4C and 4K); an intermediary transfer unit 20; unshown transfer rollers; etc.

The intermediary transfer unit 20 has: primary transfer rollers 5 (5Y, 5M, 5C and 5K); a secondary transfer roller 9; a roller 8 which opposes the secondary transfer roller 9; an intermediary transfer belt 7; a driver roller 10; a tension roller 11; etc.

The image forming operation carried out by the image forming apparatus A is as follows. As a printing start signal is outputted by an unshown controlling portion, sheets S of recording medium, which are stored in layers in a sheet storing portion 12, are sent one by one by a pickup roller 13, to a pair of registration rollers 14 by way of a pair of conveyance rollers 17. As each sheet arrives at the pair of registration rollers 14, it is adjusted in timing by the pair of registration rollers 14. Then, each sheet is sent to the image forming portion.

Meanwhile, in the image forming portion, each photosensitive drum 1 is charged by a corresponding unshown charge roller across its peripheral surface. Then, the laser scanner unit 3 emits a beam of laser light from its unshown light source in such a manner that the beam scans the charged peripheral surface of the photosensitive drum 1, while modulating the beam according to the information of the image to be formed. Consequently, an electrostatic latent image which reflects the information of the image to be formed is effected on the peripheral surface of the photosensitive drum 1.

Then, the electrostatic latent image is developed into a toner image by the developing apparatus 4; toner is adhered to the electrostatic latent image on the photosensitive drum 1 by the developing apparatus 4. Thereafter, each toner image formed on the corresponding photosensitive drum 1 is transferred (primary transfer) onto the intermediary transfer belt 7 by the application of the primary transfer bias to the primary transfer roller 5.

Since the intermediary transfer belt 7 is circularly moved by the driving force which the intermediary transfer belt 7 receives from an unshown driving force source, the toner images transferred (primary transfer) onto the intermediary transfer belt 7 arrive at the secondary transferring portion formed by the secondary transfer roller 9 and the roller 8, which opposes the secondary transfer roller 9, and are conveyed through the secondary transferring portion while the secondary transfer bias, which is opposite in polarity from the toners, is applied to the secondary transfer roller 9. Consequently, the toner images are transferred onto the aforementioned sheet.

After the transfer of the toner images onto the sheet, the sheet is sent to the fixing apparatus 15, and is conveyed through the fixing apparatus 15. While the sheet is conveyed through the fixing apparatus 15, the sheet and the toner images thereon are heated and pressed. Consequently, the toner images become fixed to the sheet. Then, the sheet is discharged out of the image forming apparatus A by a pair of discharge rollers 16.

<Member which can be Opened or Closed>

Next, a door 30, as a member which can be opened or closed relative to the main assembly 2 of the image forming apparatus A, is described about its overall structure.

Part (b) of FIG. 1 is a schematic sectional view of the image forming apparatus A when its door 30 is fully open. As is evident from part (b) of FIG. 1, the door 30 can be opened by being pivoted about a shaft 31 (pivot). As the door 30 is opened, a sheet conveyance passage which extends from the adjacencies of the pair of registration rollers 14 to the secondary transferring portion becomes exposed, making it possible to remove a sheet of recording medium if a sheet becomes jammed in the sheet conveyance passage.

Further, as the image forming apparatus A becomes substantial in its cumulative usage, it becomes necessary for various portions of the image forming apparatus A, for example, the intermediary transfer belt 7, fixing apparatus 15, etc., to be replaced with certain intervals. In this embodiment, therefore, the image forming apparatus A is structured so that when its door 30 is open, the intermediary transfer unit 20 can be moved out of the main assembly 2 to be replaced.

Figure 2:
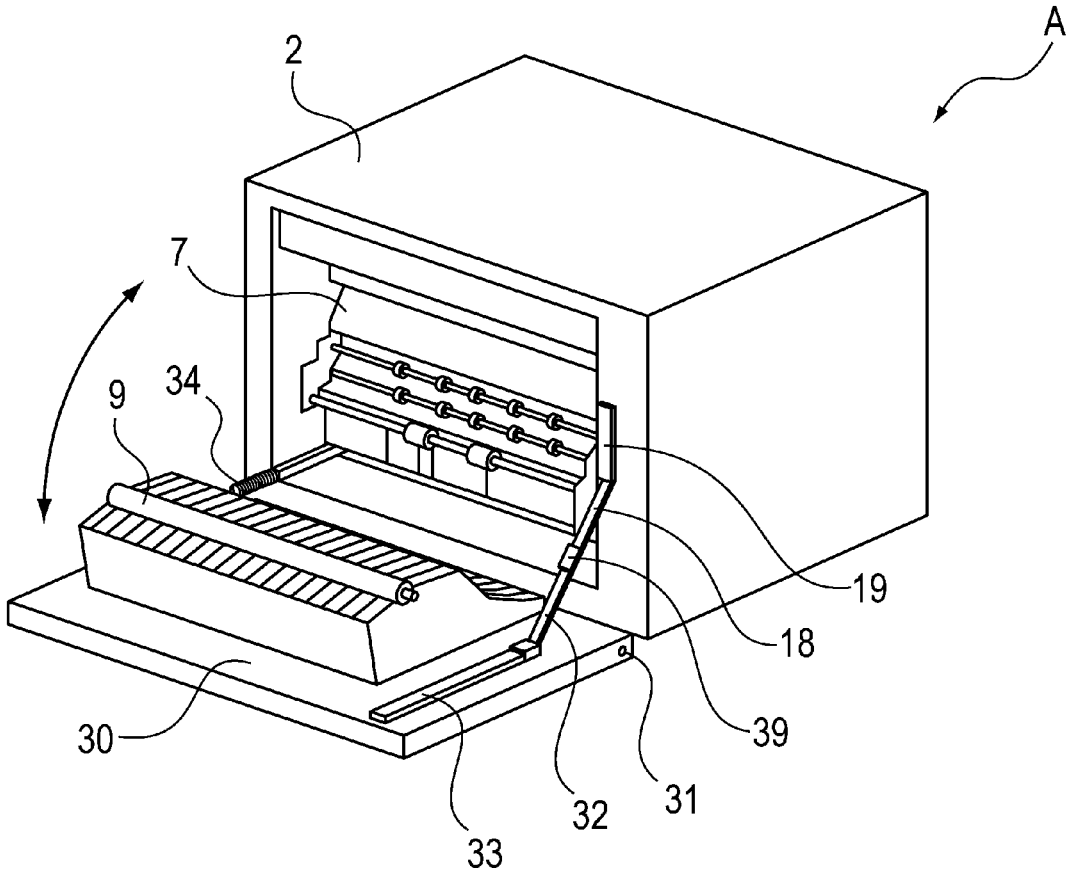
FIG. 2 is a schematic perspective view of the image forming apparatus when the door of the apparatus is open.

FIG. 2 is a schematic perspective view of the image forming apparatus A when the door 30 is open. As is evident from FIG. 2, when the door 30 is open, it is held by a combination of a strap 18 (main assembly strap) attached to the main assembly 2 of the image forming apparatus A and a strap 32 (door strap) attached to the door 30. Thereby the door 30 is regulated in its angle relative to the main assembly 2 (amount by which it is opened).

In this embodiment, the main assembly strap 18 (first connective member) and door strap 32 (second connective member) are connected by a connective portion 39. That is, the two straps 18 and 32, and connective portion 39, make up a connective member. Further, the image forming apparatus A is structured so that the main assembly strap 18 is storable in (retractable into) a holder 19 (storing member) with which the main assembly 2 of the image forming apparatus A is provided, and also, so that the door strap 32 is storable in (retractable into) a holder 33 (storing member) with which the door 30 is provided. Further, in this embodiment, the two straps 18 and 32 are flexible, and are formed of a resinous substance.

There is stretched a damping spring 34 (springy member), which is a tensional coil spring, between the main assembly 2 of the image forming apparatus A and the door 30. Part (a) of FIG. 3 is a schematic sectional view of the damping spring 34 while the door 30 is remaining closed, and part (b) of FIG. 3 is a schematic sectional view of the damping spring 34 when the door is fully open. Referring to FIG. 3, the damping spring 34 is stretched by the opening of the door 30, and thus imparts a bias to the door 30 in the direction to be closed. This pressure reduces the amount of pressure which a user has to apply to the door 30 when the user wants to close the door 30 and assists the user when the user closes the door 30.

<Connective Member>

Next, the main assembly strap 18 and door strap 32, which are parts of a connective member, are described about their structure, and their actions which occur while the door 30 is opened or closed. To begin with, their actions which occur when the door 30 is opened are described. FIG. 4 is a schematic sectional view of the door 30 and its adjacencies. It is for showing the structure of the door 30 and the adjacencies of the door 30. By the way, FIGS. 4(*a*) and 4(*b*) show the state of the door 30 and the adjacencies of the door 30 when the door 30 is open and is remaining closed, respectively.

Referring to part (a) of FIG. 4, the image forming apparatus A is structured so that the main assembly strap 18 can move in the direction −D or +D indicated by one of the double-headed arrow marks. As the door 30 is opened, the main assembly strap 18 is pulled out of the holder 19 of the main assembly of the image forming apparatus A in the direction indicated by the arrow head +D by its own weight. As the main assembly strap 18 is pulled out, its stopper portion 18*a* comes into contact with a regulating portion 19*a* of the holder 18 of the main assembly 2, being thereby regulated in movement.

Further, the image forming apparatus A is structured so that the door strap 32 can move in the holder 33 of the door 30, in the direction +E or −E indicated by another two-headed arrow mark. As the door 30 is opened, the door strap 32 is pulled out of the holder 33 in the direction +E indicated by one of two heads of the two-headed arrow mark. While the door strap 32 is pulled out of the holder 33, the stopper portion 32*a* with which the door strap 32 is provided comes into contact with the regulating portion 33*a* of the door strap 32, whereby the door strap 32 is regulated in movement.

There is disposed a strap return spring 23, which is a tension spring as a pressure generating member, in the holder 33 of the door 30. The strap return spring 23 is in connection to the door 30 by one of its lengthwise ends, and is connection to the door strap 32 by the other end. Thus, as the door strap 32 is pulled out by the opening of the door 30, the strap return spring 23 is extended. As the strap return spring 23 is extended, it generates such pressure that works in the direction indicated by the arrow head −E to pull the door strap 32 back into the holder 33 of the door 30.

Further, there is disposed a braking cam 36 in the adjacencies of the end portion 33*b* of the holder 33 of the door 30, in terms of the direction in which the door strap 32 is pulled out of the holder 33. The braking cam 36 reduces the speed with which the door 30 opens, by coming in contact with the door strap 32. The structure, function, etc., of the braking cam 36 are described later.

As described above, the main assembly strap 18 and door strap 32 are flexible enough to be bendable. In this embodiment, as the door 30 is opened, a portion 18*b* of the main assembly strap 18 and a portion 32*b* of the door strap 32 are bent relative to main assembly 2 and door 30, respectively. Since the image forming apparatus A is structured as described above, when the door 30 is open (or opened), the portion of the connective member, which is between the holder 19 of the main assembly 2 and the holder 33 of the door 30 is kept minimized in length.

Next, the various actions which occur when the door 30 is closed are described. As the door 30 begins to be closed, first, the door strap 32 begins to be retracted into the holder 33 of the door 30 by the pressure generated by the resiliency of the strap return spring 23 (in direction indicated by arrow head −E).

As for the main assembly strap 18, as the door 30 begins to be closed, the portion 18*b* of the main assembly strap 18 begins to pivot in the direction indicated by an arrow mark R1 in part (a) of FIG. 4 about the end 19*b* of the holder 19 of the main assembly 2. Then, after the door strap 32 is completely retracted, the main assembly strap 18 is pushed into the holder 19 of the main assembly 2 in the direction indicated by the arrow head −D by its own stiffness.

Next, referring to part (b) of FIG. 4, as the door 30 becomes completely closed, the main assembly strap 18 and door strap 32 become vertical, appearing as if each of them is one of the two halves into which a combination of the two straps 18 and 32 were folded at connective portion 39.

By the way, providing each of the apparatus main assembly 2 and door 30 with a portion into which a strap can be retracted makes it possible to increase the image forming apparatus A in the distance between the point of the door 30, to which a means (straps 18 and 32) for holding the door 30 at a preset angle relative to the apparatus main assembly 2, is attached, and the pivot (axle) about which the door 30 is pivotally movable, and therefore, it is possible to reduce the amount of the force to which the straps 18 and 32 are subjected.

<Mechanism for Engaging or Disengaging Intermediary Transfer Unit>

Next, a mechanism 40 for engaging the intermediary transfer unit 20 with the main assembly of the image forming apparatus A to transmit driving force to intermediary transfer unit 20 from the apparatus main assembly 2, or disengaging the intermediary transfer unit 20 from the apparatus main assembly 2, is described.

As described above, in this embodiment, the image forming apparatus A is structured so that when the door 30 is fully open, the intermediary transfer unit 20 is removably installable in the apparatus main assembly 2. If the image forming apparatus A is structured so that even when the door 30 is fully open, there remains a mechanical connection between the intermediary transfer unit 20 and apparatus main assembly 2 to allow driving force to be transmitted from the apparatus main assembly 2 to the intermediary transfer unit 20, it is very difficult to install the intermediary transfer unit 20 into the apparatus main assembly 2, or uninstall the intermediary transfer unit 20 from the apparatus main assembly 2. In this embodiment, therefore, the image forming apparatus A is structured so that as the door 30 is opened, the apparatus main assembly 2 is automatically disengaged from the intermediary transfer unit 20.

FIG. 5 is a schematic sectional view of the mechanism 40 for disengaging the intermediary transfer unit 20 from the apparatus main assembly 2, or engaging the intermediary transfer unit 20 with the apparatus main assembly 2. It is for showing the structure of the mechanism 40. Part (a) of FIGS. 5 and 5(*b*) show the state of the mechanism 40 when the door 30 remains closed or open, respectively. Referring to FIG. 5, the mechanism 40 has: a driving gear 41 (driving force transmitting portion); a linkage arm 42 which is in connection to the main assembly strap 18; a separation cam 44 (separating member); a follower 45; a coupling portion 46; etc.

The driving gear 41 is rotatably supported by the main assembly 2 of the image forming apparatus A. It is movable in the direction which is parallel to its rotational axis. Further, it is always under the pressure generated by an unshown pressure generating means in the direction parallel to the rotational axis of the driving gear 41 in a manner to press the driving gear 41 toward the coupling 21 of the intermediary transfer unit 20.

As for the separation cam 44, it is rotatably supported by the same axle as the driving gear 41. However, it is independently rotatable from the driving gear 41. Further, it is in connection to the linkage arm 42 by its connective portion 44*a*. Further, it is provided with a tapered portion 44*t*, which is in contact with the tapered portion 45*t* of the follower 45.

The follower 45 is supported by the same axle as the driving gear 41, and is movable in the direction parallel to its rotational axis. Further, it is in contact with the driving gear 41, on the opposite side from the tapered portion 45*t* in terms of the direction parallel to its rotational axis, being therefore regulated in its rotation.

Regarding the transmission of the driving force, the driving gear 41 receives driving force from the unshown driving force source with which the main assembly 2 of the image forming apparatus A is provided. Then, the rotational driving force is transmitted to the intermediary transfer unit 20, because the coupling portion 46 meshes with the coupling 21 (driving force catching portion) of the intermediary transfer unit 20.

Next, the operation carried out by the mechanism 40 for disengaging or engaging the intermediary transfer unit 20 as the door 30 is opened or closed, respectively, is described. Referring to part (a) of FIG. 5, while the door 30 is remaining closed, the coupling portion 46 remains engaged with the driving coupling 21.

Referring to part (b) of FIG. 5, as the door 30 begins to be opened, the main assembly strap 18 begins to be moved in the direction indicated by the arrow head +D by the opening movement of the door 30. Thus, the separation cam 44 which is in connection to the linkage arm 42 by way of the connective portion 44*a* is rotated in the direction indicated by an arrow mark R2 by the movement of the main assembly strap 18.

As the separation cam 44 rotates in the direction indicated by the arrow mark R2, the tapered portion 44*t* of the separation cam 44 presses the tapered portion 45*t* of the follower 45 in the direction parallel to the axial line of the follower 45. Consequently, the driving gear 41 is separated from the driving coupling 21 in the direction parallel to the rotational axis of the driving gear 41, against the pressure generated by the unshown pressing means.

Thus, the driving coupling 21 is separated from the coupling portion 46. Thus, not only is the driving force prevented from being transmitted to the intermediary transfer unit 20, but also, the driving gear 41 is moved out of the area through which the intermediary transfer unit 20 is installed into, or uninstalled from, the apparatus main assembly 2. In other words, all that is necessary for a user to do to prepare the apparatus main assembly 2 to replace the intermediary transfer unit 20 in the apparatus main assembly 2 is to open the door 30.

By the way, in this embodiment, the mechanism 40 for transmitting driving force is used to transmit driving force to the intermediary transfer unit 20. This mechanism 40, however, can be employed to drive a unit other than the intermediary transfer unit 20. For example, it can be employed to transmit driving force to the conveyance rollers 17 which convey a sheet of recording medium by sandwiching the sheet, or to interrupt the conveyance of the driving force. With the application of the mechanism 40 to the transmission of the driving force to the conveyance rollers 17, or interruption of the transmission, as the door 30 is opened by a user, the conveyance rollers 17 are disengaged from the means for transmitting driving force to the rollers 17. Therefore, a sheet of recording medium which became jammed in the recoding medium conveyance passage can be easily removed; it requires application of only a small amount of force to the jammed sheet to remove the jammed sheet.

<Braking Member>

Next, a braking cam 36, which is a braking member, is described. FIG. 6 is a schematic sectional view of the holder 33 with which the door 30 is provided. It is for describing the function of the braking cam 36. Part (a) of FIG. 6 shows the state of the braking cam 36 while the door 30 is remaining closed. Part (b) of FIG. 6 shows the state of the braking cam 36 while the door 30 is being opened. Part (c) of FIG. 6 shows the state of the braking cam 36 immediately before the door 30 becomes fully open. Part (d) of FIG. 6 shows the state of the braking cam 36 while the door 30 is being closed. FIG. 6 is drawn in such a manner that the front surface of the door 30 faces vertically downward regardless of the angle between the door and apparatus main assembly 2. Further, in FIG. 6, a solid arrow mark F1 represents the force given to the braking cam 36 from the door strap 32, whereas the dotted arrow marks N and F2 (N·μ) represent the forces applied to the door strap 32 from the braking cam 36.

Referring to FIG. 6, the braking cam 36 is supported by the holder 33 of the door 30 in such a manner that it can pivotally move about a pivot C. Further, the door strap 32 is allowed to move on the underside of the braking cam 36.

Referring to part (a) of FIG. 6, while the door 30 remains closed, the door strap 32 and braking cam 36 are positioned so that they do not apply pressure to each other.

Next, referring to part (b) of FIG. 6, as the door 30 begins to be opened, the door strap 32 comes into contact with the first area 36*a* of contact, that is, the downstream end portion of the braking cam 36, relative to the pivot C of the braking cam 36 in terms of the direction in which the door strap 32 is pulled out of the holder 33 of the door 30, and applies a pressure F1 to the braking cam 36. By the way, the first area 36*a* of contact is one of the farthest points of the braking cam 36 from the pivot C.

With the presence of this pressure F1, the braking cam 36 pivots in the direction indicated by an arrow mark R3 about the pivot C, causing thereby the second area 36*b* of contact of the braking cam 36 (other end portion braking cam 36) to come into contact with the door strap 32, on the upstream side of the pivot C in terms of the direction in which the door strap 32 is pulled out of the holder 33. That is, the braking cam 36 presses the door strap 32 against the inward wall (portion to be pressed) of the holder 33 of the door 30 in a manner to sandwich the door strap 32 between itself and the inward surface of the holder 33. By the way, the second area 36*a* of contact of the braking cam 36 is the other farthest portion of the braking cam 36 from the pivot C.

As the braking cam 36 presses the door strap 32 against the inward wall of the holder 33 of the door 30, a vertical force N is applied to the door strap 32 from the braking cam 36. Further, there are frictions (which are μ in coefficient of friction) between the braking cam 36 and door strap 32, and between the door 30 and door strap 32. Thus, friction F (=μ·N) is generated by the vertical force N in a manner to brake the door strap 32. Consequently, the door 30 is decelerated.

Referring to part (c) of FIG. 6, as the door 30 is opened further, the door strap 32 is pulled out while remaining in contact with the braking cam 36 as if it wraps around the braking cam 36. That is, the door strap 32 is pulled out of the holder 33 of the door 30 while being bent in such a manner that the wider the door 30 is opened, the greater the pressure F1 which it applies to the first area 36*a* of contact. In other words, the door strap 32 is pulled out of the holder 33 while being bent in such a manner that the angle between the portion of the door strap 32, which is out of the holder 33, and the front surface of the door, increases from θ1 to θ2. By the way, in this embodiment, the door 30 is opened by its own weight. Thus, this pressure F1 comes from the very weight of the door 30 itself.

The wider the door 30 is opened, the greater pressure F1 becomes, as described above. The greater the pressure F1, the greater the vertical force (pressure) N, which is applied to the door strap 32 by the braking cam 36. That is, the wider is the door 30 opened, the greater the friction F2, that is, the force which brakes the door strap 32, becomes. The greater the angle between the door 30 and apparatus main assembly 2 becomes, the greater the force, which acts in a manner to cause the door strap 32 to behave as if it wraps around the braking cam 36, becomes. Angle θ2 becomes greater than angle θ1. That is, the pressure F1 becomes greater, and therefore, the friction F2 increases. Thus, the wider is the door 30 opened, the greater the force which acts in the direction to reduce the door 30 in opening speed becomes.

Because the image forming apparatus A in this embodiment is structured as described above, it is possible to decelerate the door 30 of the image forming apparatus A with the use of a combination of two small and inexpensive elements, more specifically, the straps which connect the door 30 to the main assembly 2 of the image forming apparatus A, and the braking cam 36, when the door 30 is opened. Therefore, it is possible to decelerate the door 30 with the use of an inexpensive and small structural arrangement when the door 30 is opened.

Further, referring to part (d) of FIG. 6, while the door 30 is being closed, the door strap 32 does not wrap around the braking cam 36, and is made to retract into the holder 33 of the door 30 along the door 30 by its own resiliency (stiffness). Therefore, no pressure is applied to the first area 36*a* of contact of the braking cam 36 by the door strap 32; there is no pressure F1. Therefore, it does not occur that the braking force is applied to the door strap 32 from the braking cam 36.

Therefore, the amount of force required of the strap return spring 23 when the door 30 is closed has only to be large enough to retract the door strap 32 into the holder 33 of the door 30. Thus, a relatively small spring can be employed as the strap return spring 23, making it possible to reduce the image forming apparatus A in size and manufacturing cost.

By the way, regarding the shape of the braking cam 36, the braking cam 36 may be in any of the other shapes, which are described next, than the one described above. The effect of each of the braking cams different in shape from the above-described one is the same as the effect of the above-described braking cam 36.

FIGS. 7(*b*) and 7(*c*) show the braking cams 36, one for one, which are different in shape from the one in this embodiment. Part (a) of FIG. 7 shows the braking cam 36 employed in this embodiment. Referring to part (b) of FIG. 7, the braking cam 36 may be provided with the third area 36*c* of contact, which contacts the door strap 32 at a point which coincides in position with the pivot C of the braking cam 36 in terms of the moving direction of the door strap 32. That is, the braking cam 36 may be provided with the first area 36*a* of contact, which contacts the door strap 32 on the downstream side of its pivot C in terms of the direction in which the door strap 32 is pulled out of the holder 33 of the door 30, the second area 36*b* of contact, which contacts the door strap 32 on the upstream side of the pivot C, and the abovementioned third area 36*c* of contact. Referring to part (c) of FIG. 7, the braking cam 36 may be structured so that it contacts the door strap 32 by the entirety of its bottom surface. In either case, as the door 30 is opened, the door strap 32 comes into contact with the braking cam 36 as if it wraps around the braking cam 36. Therefore, vertical force N is generated. Therefore, they can provide the same effects as those described above.

By the way, in this embodiment, it is the door 30 that is provided with the braking mechanism. However, the present invention is related to the mechanism which causes the connective member to press on the braking cam 36 as if it wraps around the braking cam 36. Thus, the effects similar to those described above can be obtained even if the main assembly of the image forming apparatus A is provided with the braking mechanism. Further, the effect of decelerating the door 30 in opening speed can be improved by providing both the door 30 and the main assembly of the image forming apparatus A with the braking mechanism.

Further, in this embodiment, the image forming apparatus A is structured so that the straps are retracted into each of the main assembly of the image forming apparatus A and the door 30. However, this embodiment is not intended to limit the present invention in scope. For example, the present invention is also applicable to an image forming apparatus structured so that the straps are retracted into only one of the main assembly 2 or door 30 of the apparatus. Further, the present invention is also applicable to an image forming apparatus provided with only one strap.

Embodiment 2

Next, the image forming apparatus A in the second embodiment of the present invention is described with reference to drawings. The portions of the image forming apparatus A in this embodiment, which are the same in description as the counterparts of the image forming apparatus A in the first embodiment, are given the same referential codes as the counterparts, and are not described.

In the first embodiment, a piece of flexible band formed of a resinous substance was employed as the connective member. In this embodiment, in anticipation of a case where the door 30 is substantial in weight, a piece of fine wire, more specifically, a piece of fine metallic wire 80 is used as the connective member. By the way, in this embodiment, the image forming apparatus A is not provided with a mechanism 40 which engages the main assembly of the image forming apparatus A with the intermediary transfer unit 20 to transmit driving force to the intermediary transfer unit 20, or disengages the apparatus main assembly 2 from the intermediary transfer unit 20. Hereafter, the structure of the image forming apparatus A in this embodiment is described.

FIG. 8 is a schematic perspective view of the image forming apparatus A in this embodiment when the door 30 is fully open. Referring to FIG. 8, when the door 30 is fully open, it is held in position by being hung by the wire 80.

Further, the image forming apparatus A is structured so that the wire 80 is retractable in the wire holder 81 with which the main assembly of the image forming apparatus A is provided.

FIG. 9 is a schematic sectional view of the wire holder 81. It is for describing the function of the braking cam 36. By the way, in FIG. 9, a solid arrow mark represents a force that is applied to the braking cam 36 by the wire 80, whereas a dotted arrow mark represents the force applied to the wire 80 by the braking cam 36.

Referring to FIG. 9, there are provided in the wire holder 81, a reel 82 (reeling member) for reeling the wire 80, a protrusion 83 (pressure catching portion) formed of a metallic substance which is highly resistant to frictional wear, and a braking cam 36, listing from the upstream side in terms of the direction in which the wire 80 is pulled out of the holder 81. By structuring the image forming apparatus A so that the wire 80 is reeled by the reel 82 as described above, it is possible to reduce the wire holder 81 in size.

Further, in order to minimize the friction between the braking cam 36 and wire 80, the first area 36*a* of contact of the braking cam 36, which contacts the wire 80, on the downstream side of the pivot C in terms of the direction in which the wire 80 is pulled out of the wire holder 81, is provided with the first roller 84 which is rotatably supported. Further, the second area 36*b* of the braking cam 36, which contacts the wire 80, on the upstream side of the pivot C, is provided with the second roller 85 which is rotatably supported.

Next, the function of the braking cam 36 is described.

As the door 30 begins to be opened, the wire 80 comes into contact with the first area 36*a* of contact, and begins to apply a pressure F1 to the first area 36*a* of contact. As the door 30 is opened further, the wire 80 is pulled out of the wire holder 81 while being bent in such a manner that the pressure F1 applied to the first area 36*a* of contact by the wire 80 increases, as if it wraps around the braking cam 36. By the way, in this embodiment, the door 30 is made to open by its own weight. Thus, the pressure F1 is attributable to the weight of the door 30 itself.

With the application of the pressure F1 to the braking cam 36 by the wire 80, the braking cam 36 pivots in the direction indicated by an arrow mark R4 about the pivot C. Consequently, the second area 36*b* of contact comes into contact with the wire 80, and presses the wire 80 upon the protrusive portion 83 in a manner to sandwich the wire 80 between itself and protrusive portion 83. As the wire 80 is pressed upon the protrusive portion 83, a vertical force N is applied to the wire 80 by the braking cam 36. There are frictions ($\mu$ in coefficient) between the braking cam 36 and wire 80, and between the protrusive portion 83 and the wire 80. Therefore, the friction F2, the amount ($\mu \cdot N$) is obtainable from the vertical force N and coefficient $\mu$ functions as such force that brakes the movement of the wire 80. Consequently, the door 30 is decelerated.

Since the image forming apparatus A is structured as described above, the wider the door 30 is opened, the greater the braking force which acts to decelerate the door 30. Therefore, it is possible to decelerate the door 30 with the use of only two inexpensive elements, more specifically, the wire 80 which connects the door 30 and the apparatus main assembly 2 to each other, and the braking cam 36. That is, it is possible to decelerate the door 30, with the employment of a relatively inexpensive and small structural arrangement, when the door 30 is opened. Further, by adjusting the protrusive portion 83, which is the portion to be pressed, and the wire 80, in coefficient $\mu$ of friction, and also, adjusting the protrusive portion 83 in height, it is possible to optimize the braking force. Further, by forming the protrusive portion 83 of a metallic substance, it is possible to increase the protrusive portion 83 in the resistance to frictional wear, and therefore, it is possible to extend the protrusive portion 83 in durability.

Further, by using a piece of fine metallic wire, such as the wire 80, as the connective member, not only is it possible to reduce the image forming apparatus A in size, but also, to simplify the connective member in appearance when the door 30 is open, because the connective member is made up of only a piece of fine wire. By the way, in this embodiment, a piece of fine metallic wire was used as the connective member, in anticipation of a case where the door 30 is substantial in weight. This embodiment, however, is not intended to limit the present invention is scope in terms of the material for the connective member. That is, the present invention is also applicable to an image forming apparatus, the connective member of which is formed of a substance other than the metallic wire, for example, a resinous substance, because of the weight of the door 30 and/or required durability.

By the way, in the first and second embodiments of the present invention described above, the member which can be opened or closed, and to which the present invention was applied was the door 30 for exposing the sheet conveyance passage when the sheet conveyance passage became jammed with a sheet of recording medium. However, they are not intended to limit the present invention in scope. For example, the present invention is also applicable to an image forming apparatus which is provided with photosensitive drums, developing apparatuses, etc., employs process cartridges removably installable in the main assembly of the image forming apparatus, and also, is provided with a door or the like for replacing the process cartridges.

According to the present invention, a member of an image forming apparatus, which can be opened or closed, can be decelerated with the employment of a relatively inexpensive and small structural arrangement, while the member is opened.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-128608 filed on Jun. 29, 2016, which is hereby incorporated by reference herein in its entirety.

What is claimed is:

1. An image forming apparatus for forming an image on a recording material, said apparatus comprising:

a main assembly;

an openable member openable and closable relative to said main assembly;

a flexible connecting member connecting said openable member with said main assembly, said connecting member being slidable relative to at least one of said main assembly and said openable member, wherein said connecting member slides with opening of said openable member relative to said main assembly; and a sliding member swingably supported by said main assembly or said openable member and slidable relative to said connecting member which slides, wherein when said openable member is opened, said connecting member contacts, while sliding, a part of said sliding member on one side with respect to a center of swing to press said sliding member, so that the other side with respect to the center of swing of said sliding member urges said connecting member to an urged portion to retard a sliding movement of said connecting member.

2. An apparatus according to claim 1, further comprising an accommodation member configured to accommodate said connecting member, wherein said connecting member is drawn out of said accommodation member with opening of said openable member.

3. An apparatus according to claim 2, wherein with an opening movement of said openable member, said connecting member is drawn out while being bent in a direction of winding on said sliding member.

4. An apparatus according to claim 2, wherein said sliding member is provided inside said accommodation member.

5. An apparatus according to claim 2, wherein said accommodation member is provided with a winding member for winding said connecting member up.

6. An apparatus according to claim 2, wherein when said openable member is closed, said connecting member is accommodated in said accommodation member without pressing said sliding member.

7. An apparatus according to claim 2, wherein said connecting member includes a first connecting member supported by main assembly and a second connecting member supported by said openable member and connected with first connecting member.

8. An apparatus according to claim 7, wherein said accommodation member includes a first accommodation member provided in said main assembly and configured to accommodate said first connecting member, and a second accommodation member provided on said openable member and configured to accommodate said second connecting member, wherein at least one of said first accommodation member and said second accommodation member is provided with said sliding member.

9. An apparatus according to claim 2, wherein said accommodation member is provided on said openable member, and includes an urging member for urging said connecting member in the direction of accommodating the accommodation member.

10. An apparatus according to claim 2, wherein said accommodation member is provided in said main assembly.

11. An apparatus according to claim 1, wherein said sliding member is provided with a roller at a position contacting said connecting member.

12. An apparatus according to claim 1, further comprising a spring member between said main assembly and said openable member and configured to urge said openable member in a direction of closing said openable member when said openable member is opened.

13. An apparatus according to claim 1, further comprising a cam member rotatable in interrelation with movement of said connecting member, and a drive transmitting portion movable in interrelation with rotation of said cam member and configured to transmit a driving force to a driving force receiving portion, wherein when said openable member is opened, said drive transmitting portion is spaced from said driving force receiving portion to disconnect transmission of the driving force in interrelation with rotation of said cam member.

14. An apparatus according to claim 1, wherein said connecting member is in the form of wire.

15. An apparatus according to claim 1, wherein said urged portion is made of metal.

16. An image forming apparatus for forming an image on a recording material, said apparatus comprising:

a main assembly;

an openable member openable and closable relative to said main assembly;

a flexible connecting member connecting said openable member with said main assembly, said connecting member being slidable relative to at least one of said main assembly and said openable member, wherein said connecting member slides with opening of said openable member relative to said main assembly; and a swingable member swingably supported by said main assembly or said openable member about a center of swing and slidable relative to said connecting member which slides, wherein when said openable member is opened, said connecting member presses, while sliding, a part of said swingable member on one side of the center of swing, thereby the other side of said swingable member with respect to the center of swing urges said connecting member.

17. An apparatus according to claim 16, wherein a force applied by the other side of said swingable member to said connecting member increases with a swing angle of said swingable member which changes with a force applied by said connecting member to the one side of said swingable member.

18. An apparatus according to claim 17, wherein a sliding movement of said connecting member is decelerated by the other side of said swingable member urging said connecting member.

19. An apparatus according to claim 16, further comprising an accommodation member configured to accommodate said connecting member, wherein said connecting member is drawn out of said accommodation member with opening of said openable member.

20. An apparatus according to claim 19, wherein with an opening movement of said openable member, said connecting member is drawn out while being bent in a direction of winding on said swingable member.

* * * * *